US011255549B2

(12) United States Patent
Scalf et al.

(10) Patent No.: US 11,255,549 B2
(45) Date of Patent: Feb. 22, 2022

(54) COOKING APPLIANCE WITH REPOSITIONABLE VENT ARM

(71) Applicant: Midea Group Co., Ltd., Foshan (CN)

(72) Inventors: Eric Scalf, Louisville, KY (US); Robert M. Digman, Goshen, KY (US); Mark W. Wilson, Simpsonville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 31 days.

(21) Appl. No.: 16/916,523

(22) Filed: Jun. 30, 2020

(65) Prior Publication Data

US 2020/0333019 A1 Oct. 22, 2020

Related U.S. Application Data

(62) Division of application No. 16/223,795, filed on Dec. 18, 2018, now Pat. No. 10,697,647.

(51) Int. Cl.
*F24C 15/20* (2006.01)
*H05B 6/64* (2006.01)

(52) U.S. Cl.
CPC ..... *F24C 15/2085* (2013.01); *F24C 15/2042* (2013.01); *H05B 6/6426* (2013.01)

(58) Field of Classification Search
CPC ..... F24C 15/2042; F24C 15/205; F24C 15/2071; F24C 15/2078; F24C 15/2085; F24C 15/2092
See application file for complete search history.

(56) References Cited

U.S. PATENT DOCUMENTS 3,698,378 A * 10/1972 Rosenberg ..... F24C 3/047 126/39 R
4,074,680 A * 2/1978 Gooding ..... F24B 1/18 126/301
4,086,847 A * 5/1978 Overmyer ..... B08B 15/005 104/52
4,858,591 A * 8/1989 Fu ..... F24C 15/2085 126/299 D (Continued)

FOREIGN PATENT DOCUMENTS

CN 201925998 U 8/2011
CN 107339731 A 11/2017

(Continued)

OTHER PUBLICATIONS

Frigidaire, 30 in. Telescopic Downdraft System in Stainless Steel, www.homedepot.com, Retrieved on Jul. 27, 2018.

(Continued)

*Primary Examiner* — David J Laux
(74) *Attorney, Agent, or Firm* — Middleton Reutlinger

(57) ABSTRACT

A venting appliance for use with a cooking appliance including a cooktop with at least one cooking element disposed thereon, where the venting appliance may include: a housing configured to be positioned above the cooktop; a repositionable vent arm coupled to and extending below the housing; and a controller coupled to the repositionable vent arm and configured to determine that a first cooking element among at least one cooking elements is active, and in response thereto, automatically reposition the vent arm to be closer to the first cooking element.

17 Claims, 6 Drawing Sheets

(56) References Cited

U.S. PATENT DOCUMENTS

| | | | | |
|---|---|---|---|---|
| 5,482,505 | A * | 1/1996 | Hedlund | B08B 15/002 285/302 |
| 5,791,980 | A * | 8/1998 | Kramer, Jr. | F23J 11/02 285/302 |
| 6,524,180 | B1 * | 2/2003 | Simms | B08B 15/002 285/184 |
| 6,647,978 | B1 | 11/2003 | Khosropour et al. | |
| 6,886,554 | B2 * | 5/2005 | Cheng | F24C 15/2078 126/299 D |
| 7,836,877 | B2 | 11/2010 | Gagas et al. | |
| 8,020,549 | B2 | 9/2011 | Huber et al. | |
| 8,079,359 | B2 | 12/2011 | Chung | |
| 8,312,873 | B2 | 11/2012 | Gagas et al. | |
| 9,175,862 | B2 | 11/2015 | Chtchetinin | |
| 9,677,772 | B2 | 6/2017 | Siegel et al. | |
| 10,041,687 | B1 * | 8/2018 | Caneba | F24C 15/20 |
| 2006/0231553 | A1 | 10/2006 | Gerami | |
| 2006/0278215 | A1 | 12/2006 | Gagas et al. | |
| 2007/0062513 | A1 * | 3/2007 | Gagas | F24C 15/2021 126/299 D |
| 2007/0079823 | A1 * | 4/2007 | Shin | F24C 15/2085 126/299 D |
| 2010/0059040 | A1 * | 3/2010 | Shaffer | F24C 15/2042 126/299 D |
| 2010/0065038 | A1 | 3/2010 | Davies | |
| 2017/0016630 | A1 | 1/2017 | Yang et al. | |

FOREIGN PATENT DOCUMENTS

| | | | |
|---|---|---|---|
| EP | 1614968 | A1 | 1/2006 |
| KR | 200329846 | Y1 | 10/2003 |

OTHER PUBLICATIONS

Alibaba, Korean Barbecue Grill Exhaust Hood Exhaust Pipe and a Half Copper Hose Retractable | Commerical Barbecue Grill Exhaust Pipe, www.alibaba.com, Retrieved on Jul. 27, 2018.

* cited by examiner

COOKING APPLIANCE WITH REPOSITIONABLE VENT ARM

BACKGROUND

Various cooking appliances used in the home, e.g., ranges, cooktops, ovens, etc., can affect the environment within a home during their operation. Cooking appliances often generate heat, steam, moisture and/or odors as byproducts of the cooking process. Many homes and commercial kitchens may for example, be equipped with hoods or vents that are positioned over or adjacent to a cooking appliance to draw in air in the immediate vicinity of the cooking appliance in an attempt to address these cooking byproducts. Some hoods or vents are vented to the exterior of the home, while others merely recirculate the air in the immediate vicinity of the cooking appliance. However, these hoods or vents have limited effect due to their location; for example many of these hoods or vents are positioned approximately 30 inches above the cooktop, so their ability to capture cooking byproducts emanating from a particular location on a cooking appliance (e.g., from a specific pot or pan placed on the cooking appliance) is limited. Moreover, conventional hoods and/or vents are generally operated manually by a user via separate controls from the cooking appliance.

SUMMARY

The herein-described embodiments address these and other problems associated with the art by providing in one aspect a cooking appliance and method of controlling one or more repositionable vent arms. Therefore, consistent with one aspect of the invention, a venting appliance for use with a cooking appliance of a type including a cooktop with at least one cooking element disposed thereon may include: a housing configured to be positioned above the cooktop; a repositionable vent arm coupled to and extending below the housing; and a controller coupled to the repositionable vent arm and configured to determine that a first cooking element among the at least one cooking elements is active, and in response thereto, automatically reposition the vent arm to be closer to the first cooking element.

In some embodiments, the controller determines that the first cooking element is active based on a signal from a thermal sensor positioned to detect heat emanating from the first cooking element. In such instances, the controller may determine that the first cooking element is active based on a signal received from the cooking appliance. For example, in some instances, the signal comprises a wireless signal generated in response to the first cooking element being put in an active state in response to user input, where the venting appliance further comprises a wireless receiver configured to receive the wireless signal from the cooking appliance. In some embodiments, the controller is disposed in the housing. In other embodiments, the controller is disposed in the cooking appliance.

In some embodiments, the venting appliance further includes a fan coupled to the controller and configured to draw air through the repositionable vent arm, where the controller is configured to activate the fan in response to the determination that the first cooking element is active. In such instances, the fan may be a first fan that provides focused ventilation for the first cooking element, where the venting appliance further including an area inlet disposed in the housing and a second fan coupled to the controller and configured to draw air through the area inlet to provide area ventilation for the cooktop.

In some embodiments, the repositionable vent arm further includes a distance sensor coupled to the controller and configured to sense a distance to an object disposed on the first cooking element, where the controller is configured to reposition the repositionable vent arm in response to a signal from the distance sensor. In other embodiments, the venting appliance additionally includes a vent arm drive coupled to the controller and configured to move the vent arm in a direction generally perpendicular to the cooktop, where the controller is configured to automatically reposition the vent arm to be closer to the first cooking element by actuating the vent arm drive to move the vent arm in the direction generally perpendicular to the cooktop. In some embodiments, the vent arm drive comprises a belt drive. In other embodiments, the vent arm includes a set of telescoping cylinders that are selectively extended in response to the vent arm drive. In still other embodiments, the vent arm drive comprises a first vent arm drive, where the venting appliance additionally includes a second vent arm drive configured to move the vent arm in a direction generally parallel to the cooktop, and where the controller is configured to automatically reposition the vent arm to be closer to the first cooking element further by actuating the second vent arm drive to move the vent arm generally parallel to the cooktop.

In some embodiments, the repositionable vent arm is rotatable about an axis of rotation that is generally perpendicular to the cooktop, wherein the repositionable vent arm includes a laterally-extending member disposed at an opposite end of the repositionable vent arm from the housing, wherein an inlet of the repositionable vent arm is disposed at an opposite end of the laterally-extending member from the axis of rotation, and wherein rotation of the repositionable vent arm repositions the inlet in a direction generally parallel to the cooktop. In other embodiments, the repositionable vent arm is a first vent arm among plurality of vent arms, each of which disposed above an associated cooking element among the at least of cooking element, and where the controller is configured to automatically reposition each of the plurality of vent arms to be closer to the associated cooking element for such vent arm in response to determining that the associated cooking element for such vent arm is active.

In some embodiments, the venting appliance is disposed on an underside of a microwave oven. In other embodiments, the venting appliance is a vent hood.

Consistent with another aspect of the invention, a venting appliance for use with a cooking appliance of a type including a cooktop with at least one cooking element disposed thereon may include: a housing configured to be positioned above the cooktop; a repositionable vent arm coupled to and extending below the housing, the repositionable vent arm including an inlet disposed at an opposite end of the repositionable vent arm from the housing; a first fan coupled to the repositionable vent arm to draw air through the inlet of the repositionable vent arm to provide focused ventilation proximate the inlet of the repositionable vent arm; an area inlet disposed in the housing; and a second fan configured to draw air through the area inlet to provide area ventilation for the cooktop; wherein the first and second fans are independently controllable by a user.

In some embodiments, the venting appliance additionally includes a controller coupled to the repositionable vent arm and configured to determine that a first cooking element among the at least one cooking element is active, and in response thereto, automatically reposition the vent arm to be closer to the first cooking element. In other embodiments, the venting appliance additionally includes a vent arm drive coupled to the controller and configured to move the vent arm in a direction generally perpendicular to the cooktop, where the controller is configured to automatically reposition the vent arm to be closer to the first cooking element by actuating the vent arm drive to move the vent arm in the direction generally perpendicular to the cooktop.

In some embodiments, the vent arm drive includes a first vent arm drive, and the venting appliance additionally includes a second vent arm drive configured to move the vent arm in a direction generally parallel to the cooktop, and where the controller is configured to automatically reposition the vent arm to be closer to the first cooking element further by actuating the second vent arm drive to move the vent arm generally parallel to the cooktop.

In some embodiments, the controller determines that the first cooking element is active based on a signal from a thermal sensor positioned to detect heat emanating from the first cooking element. In other embodiments, the repositionable vent arm further includes a distance sensor coupled to the controller and configured to sense a distance to an object disposed on the first cooking element, where the controller is configured to reposition the repositionable vent arm in response to a signal from the distance sensor.

Consistent with another aspect of the invention, a method of venting using a venting appliance that includes a housing configured to be positioned above a cooktop of a cooking appliance, a repositionable vent arm coupled to and extending below the housing, and a controller coupled to the repositionable vent arm, includes: determining, by the controller, that a first cooking element of the cooking appliance is active; and automatically repositioning, by the controller, the repositionable vent arm to be closer to the first cooking element in response to the determination.

In some embodiments, the step of determining that the first cooking element is active further includes receiving, by the controller, a signal, from a thermal sensor disposed on the housing, that heat is emanating from the first cooking element. In other embodiments, the step of determining that the first cooking element is active further includes receiving, by the controller, a signal, from the cooking appliance, where the signal comprises a wireless signal generated in response to the first cooking element being put in an active state in response to user input and where the venting appliance further comprises a wireless receiver configured to receive the wireless signal from the cooking appliance.

In some embodiments, the step of automatically repositioning the vent arm further includes: receiving, by the controller, a signal from a distance sensor configured to sense a distance to an object disposed on the first cooking element; and repositioning the vent arm in response to the signal from the distance sensor.

In some embodiments, the method additionally includes activating a fan configured to draw air through the repositionable vent arm, by a controller, in response to the determination that the first cooking element is activate.

In some embodiments, the vent arm further includes a vent arm drive coupled to the controller and configured to move the vent arm in a direction generally perpendicular to the cooktop, and where the automatic repositioning the vent arm further includes repositioning, by the vent arm drive, the vent arm to be closer to the first cooking element by actuating the vent arm drive to move the vent arm in the direction generally perpendicular to the cooktop. In such instances, the vent arm drive may include a first vent arm drive, where the venting appliance further comprises a second vent arm drive configured to move the vent arm in a direction generally parallel to the cooktop, and where the automatic repositioning the vent arm further includes repositioning, by the second vent arm drive, the vent arm to be closer to the first cooking element by actuating the vent arm drive to move the vent arm in the direction generally parallel to the cooktop.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

FIG. 1A is a front view of the cooking and venting appliance. FIG. 1B is a bottom view of the venting appliance of FIG. 1A.

FIG. 3A is a front view of the venting appliance; FIG. 3B is a bottom view of the venting appliance of FIG. 3A.

DETAILED DESCRIPTION

Figure 1A:
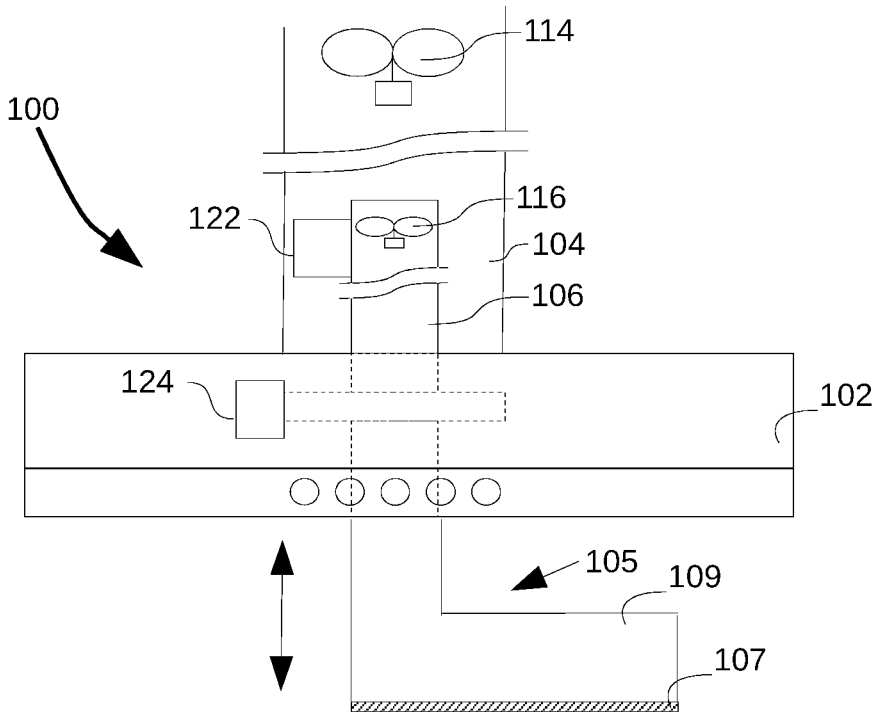
FIGS. 1A-B are functional views of a cooking appliance and associated venting appliance with a repositionable vent arm consistent with some embodiments of the invention.

Turning now to the drawings, wherein like numbers denote like parts throughout the several views, FIG. 1A illustrates an example cooking appliance 10 and venting appliance 100 in which the various technologies and techniques described herein may be implemented. Venting appliance 100, in particular, may be positioned over cooking appliance 10, and may include one or more repositionable vent arms as will become more apparent below that enable focused venting to be performed for one or more cooking elements of the cooking appliance.

Cooking appliance 10 in the illustrated embodiment is a residential-type range, and as such includes a housing 12 and a cooktop 14 including a plurality of cooking elements 16. The cooking appliance may also include an oven accessed via an oven door having a handle (not illustrated). The cooking appliance 10 may also include a storage drawer in some embodiments, or in other embodiments, may include a second oven (also not illustrated). Various types of cooking elements may also be incorporated into cooking appliance 10 for cooking food in the oven, e.g., one or more electric, inductive or gas heating elements.

Cooking appliance 10 may also include various user interface devices, including, for example, control knobs 28 for controlling cooking elements 16, a control panel for controlling the oven and/or cooking elements 16, and a display 32 for providing visual feedback as to the activation state of the cooking appliance 10. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments, audio feedback may be provided to a user via one or more speakers; and in some embodiments, user input may be received through a spoken or a gesture-based interface.

As noted above, cooking appliance 10 of FIG. 1A is a range, which combines both a stovetop and one or more ovens, and which in some embodiments may be a standalone or drop-in type of range. In other embodiments, however, cooking appliance 10 may be another type of cooking appliance, e.g., a drop-in stovetop, etc. In general, a venting appliance 100 consistent with the invention may be utilized with any residential-type cooking appliance including a housing and one or more cooking elements disposed thereon and/or therein and configured to generate energy for cooking food.

In turn, a cooking element may be considered to include practically any type of energy-producing element used in residential applications in connection with cooking food, e.g., employing various cooking technologies such as electric, gas, light, microwaves, induction, convection, radiation, etc. In the case of a stovetop, one or more cooking elements therein may be gas, electric, or inductive heating elements in some embodiments. Further, it will be appreciated that any number of cooking elements 16 may be provided in a cooking appliance, and that multiple types of cooking elements may be combined in some embodiments.

Various embodiments of a venting appliance with one or more repositionable vent arms are described herein. Such repositionable vent arms may automatically move in response to the activation of a cooking element sensed by a thermal sensor or the detection of user control activation of the cooking element. The movement of the repositionable vent arms places them in closer proximity to the active cooking element, allowing the repositionable vent arm to provided focused ventilation to the air nearest the active cooking element. In some instances, these repositionable vent arms include their own fan either in addition to or in lieu of a general ventilation fan typically placed in a housing above the cooktop.

Figure 1A:
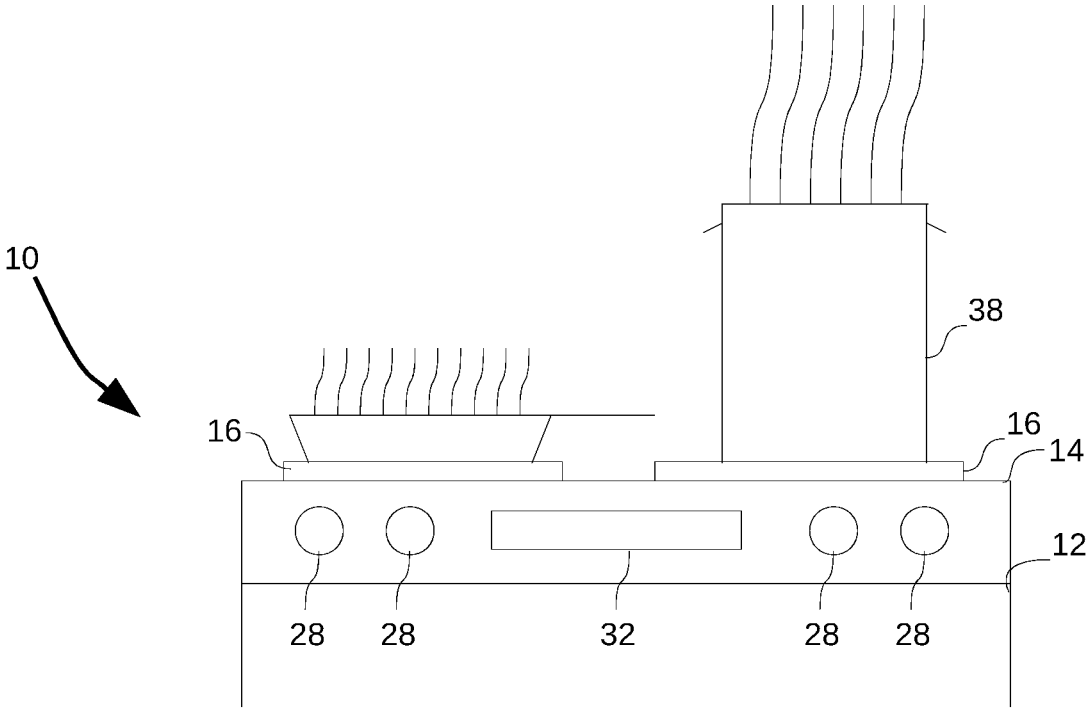
Figure 1B:
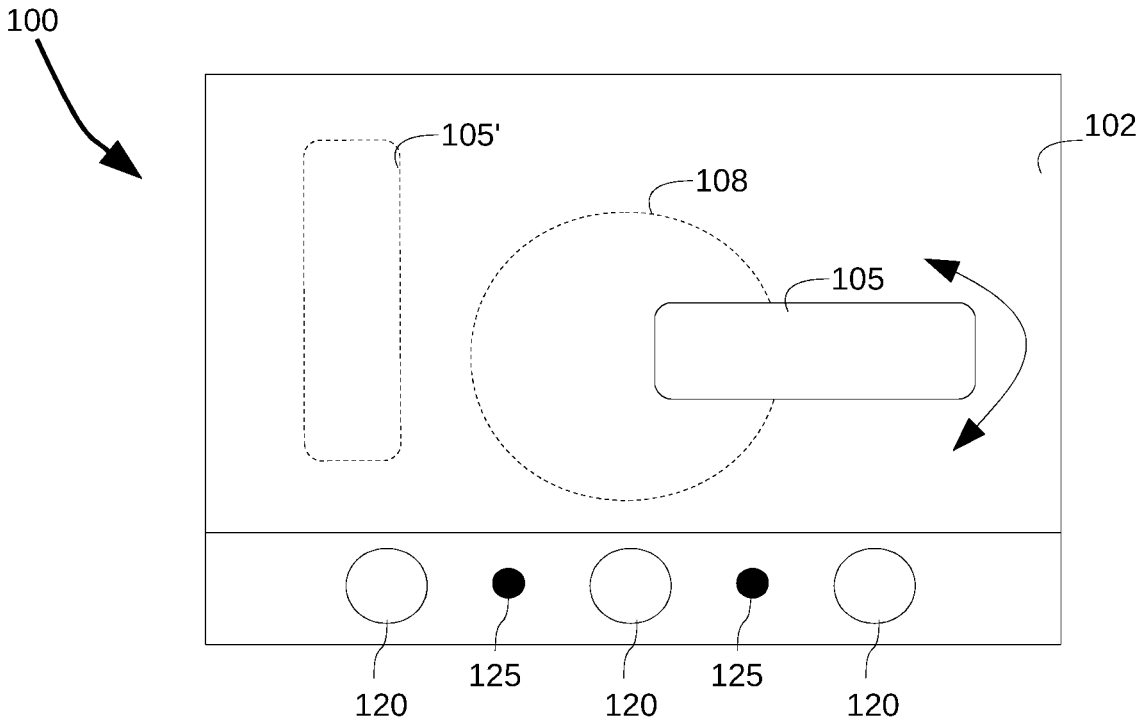

FIGS. 1A-B illustrate an example of a venting appliance 100 including a pipe-in-pipe configuration where a housing 102 may be coupled to an exhaust conduit 104 with an associated fan 114, into which another focused exhaust conduit 106 (a portion of a repositionable vent arm 105) with an associated focused fan 116 may retract when not in use. This housing 102 may, in some instances, additionally include one or more lights 120 for illuminating the cooking surface, one or more sensors 125 (described in detail herein), and an area inlet 108 (area illustrated in broken lines of FIG. 1B) for whole cooktop ventilation. This area inlet 108 may be in fluid communication with the exhaust conduit 104 so that air may be drawn through this area inlet 108 to provide area (or general) ventilation for the cooktop.

The repositionable vent arm 105 may include a focused exhaust conduit 106, which may be coupled to a focused fan 116 in order to provide focused ventilation. The repositionable vent arm 105 may also include a laterally-extending member 109 positioned opposite the housing. This laterally-extending member 109 may additionally include an inlet 107 of the repositionable vent arm that is positioned at an opposite end of the laterally-extending member from the focused exhaust conduit 106; the inlet 107 fluidly coupled to the focused exhaust conduit 106 and configured to draw air through the inlet 107 to provide focused ventilation for the cooktop.

A vent arm drive 122 (e.g. a motor or the like) may allow the repositionable vent arm 105 to move vertically (e.g. perpendicular to the cooktop 14), as indicated by the arrow in FIG. 1A, so as to stabilize closer to the cooktop 14 and collect the moisture, odor, etc. laden air before it escapes into the surrounding atmosphere. The repositionable vent arm 105 may also move in a second direction, e.g., using a second vent arm drive 124, that is in a plane generally parallel to the cooktop 14, as indicated by the arrow in FIG. 1B. Such multidirectional movement may allow the repositionable vent arm 105 to stabilize over a specific zone or pot or pan on a cooking element 16 that needs venting. As a non-limiting example, the inlet 107 of the repositionable vent arm 105 may be positioned over a large pot of boiling water 38, so that air is drawn through the inlet 107 to capture the moisture rich air over the boiling water 38 preventing it from escaping into the surrounding atmosphere. Alternatively, the repositionable vent arm may be disposed over the most commonly used cooking element(s), as illustrated in broken line at 105' in FIG. 1B, and move only vertically (e.g. perpendicular to the cooktop 14). Movement of a vent arm in the vertical direction (perpendicular to a cooktop) and in the horizontal direction (parallel to the cooktop) may be implemented in different embodiments using rotation, translation or a combination thereof.

Figure 2:
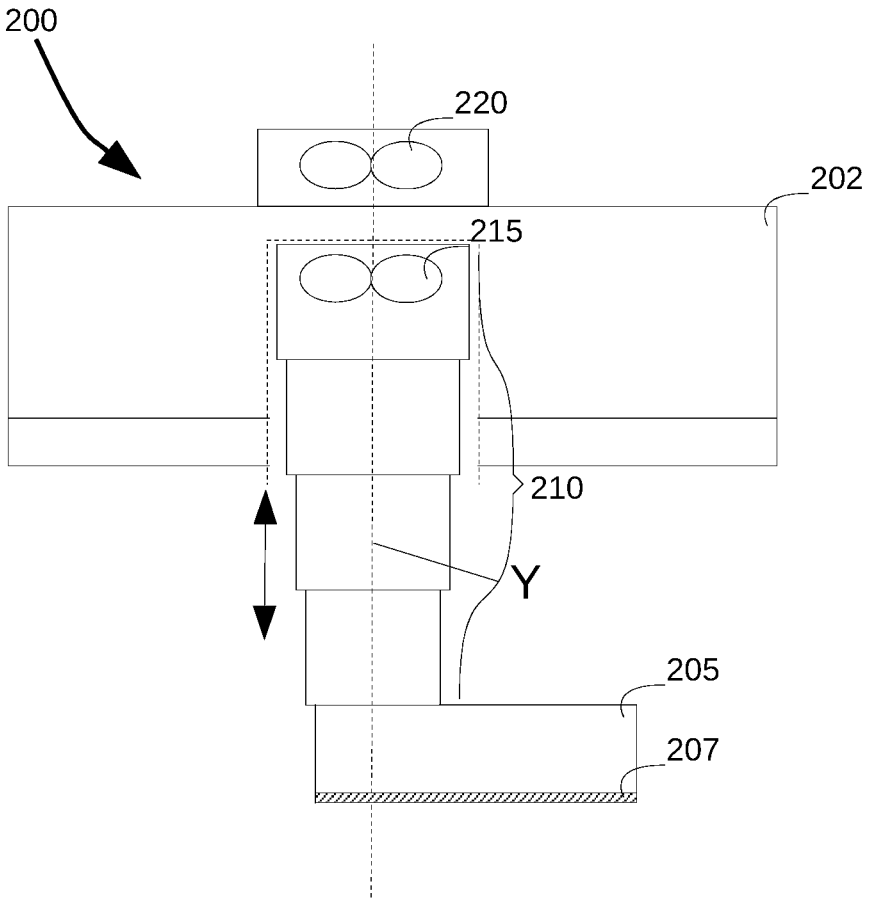
FIG. 2 is a functional view of a venting appliance with a repositionable vent arm consistent with some embodiments of the invention.

For example, in embodiments utilizing only translational movement, the vent drive 122 may be a belt drive oriented to raise and lower the focused exhaust conduit 106 and repositionable vent arm 105 vertically, while the second vent arm drive 124 may be one or more belt drives (e.g., arranged in a gantry) oriented to move the repositionable vent arm 105 horizontally. In embodiments utilizing only rotation to achieve movement of the vent arm 105 in both vertical and horizontal direction, the vent drive 122 may be a motor that powers rotation in a spiral pattern moving both vertically and horizontally. In embodiments utilizing both translation and rotation to achieve movement of the vent arm 105 in both vertical and horizontal direction, there may be a first vent drive 122, such a belt drive, oriented to raise and lower the focused exhaust conduit 106 and repositionable vent arm 105 vertically, while the second vent arm drive 124 may be a motor that powers rotation axis of rotation that is generally perpendicular to the cooktop. FIG. 2 illustrates another example of a venting appliance 200; in the embodiment illustrated in FIG. 2, the repositionable vent arm 205 is coupled to a telescoping exhaust conduit 210. Such a telescoping exhaust conduit 210 may utilize hydraulic cylinders, pneumatic cylinders, driven belts or chains, or other suitable types of drive mechanisms to provide a movement to and from a compact retracted length. Similar to the embodiment illustrated in FIGS. 1A-B, the venting appliance 200 may include a housing 202, which may additionally include one or more lights (not illustrated) for illuminating the cooking surface, one or more sensors (not illustrated), and an area inlet (not illustrated) for whole cooktop ventilation. Also similar to the embodiment illustrated in FIGS. 1A-B, the repositionable vent arm 205 may move vertically (e.g. perpendicular to a cooktop), as indicated by the arrow allowing the repositionable vent arm 205 to stabilize closer to the cooktop and focus the collection of moisture, odor, etc. laden air before it escapes into the surrounding atmosphere. The repositionable vent arm 205 may also move in a second direction that is in a plane generally parallel to the cooktop. As an example, the repositionable vent arm 205 may rotate about an axis (Y) running through the telescoping exhaust conduit 210. This multidirectional movement may allow the repositionable vent arm 205 to stabilize over a specific zone or pot or pan on a cooking element that needs venting, so that air is drawn through the inlet 207.

The repositionable vent arm 205 and telescoping exhaust conduit 210 may be coupled to a focused fan 215 in order to draw air from an inlet 207 of the repositionable vent air and through the telescoping exhaust conduit 210. In some embodiments, such as illustrated in FIG. 2, the venting system 200 may further include a general fan 220 for providing general ventilation for the whole cooktop. In some embodiments, either the controller or a user may separately control the focused fan 215 and the general fan 220.

Figure 3A:
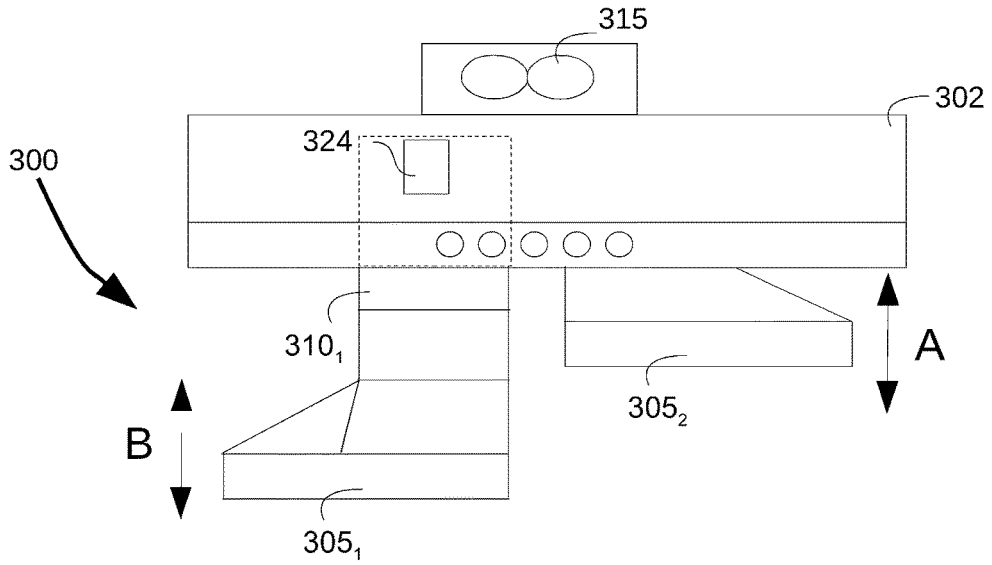
FIGS. 3A-B are functional views of a venting appliance with multiple repositionable vent arms consistent with some embodiments of the invention.
Figure 3B:
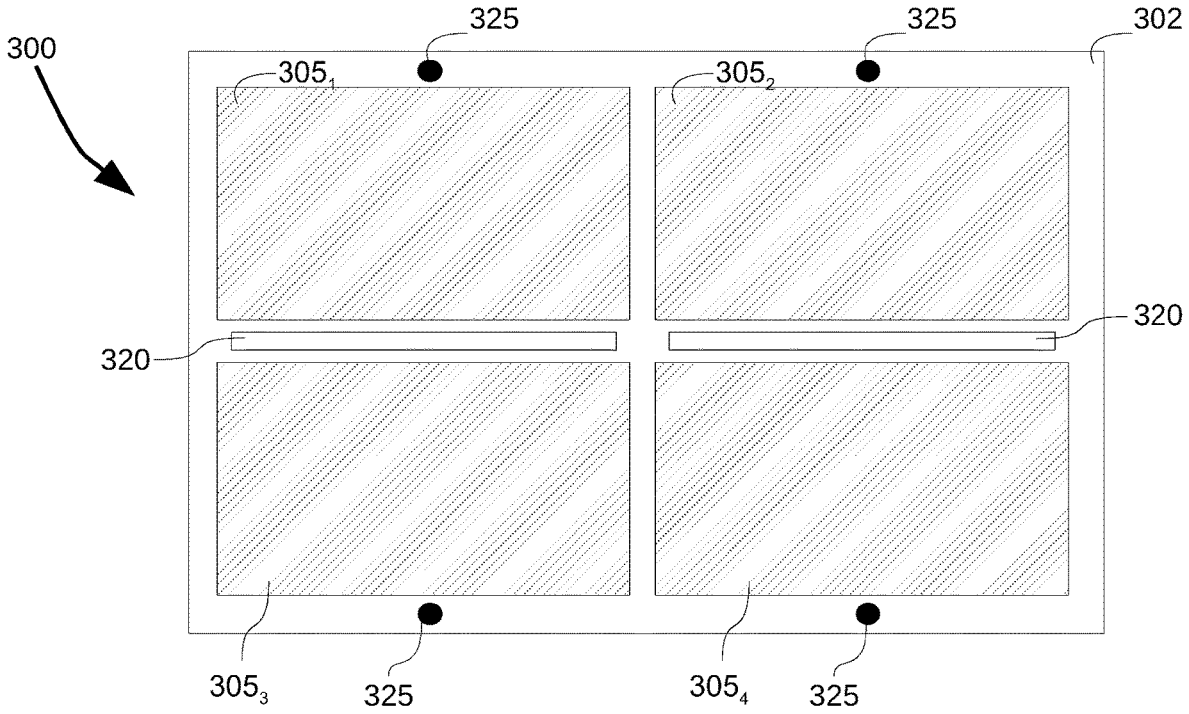

FIGS. 3A-B illustrate yet another example of a venting appliance 300 with a plurality of repositionable vent arms $\mathbf{305}_{1\text{-}n}$. Each of the repositionable vent arms $\mathbf{305}_{1\text{-}n}$ may include a telescoping exhaust conduit $\mathbf{310}_{1\text{-}n}$ configured to move vertically (e.g. perpendicular to a cooktop), as indicated by the arrows in FIG. 3A, allowing each repositionable vent arm $\mathbf{305}_{1\text{-}n}$ to stabilize closer to the cooktop and focus the collection of moisture, odor, etc. laden air before it escapes into the surrounding atmosphere. Each telescoping exhaust conduit $\mathbf{310}_{1\text{-}n}$ may contain a vent drive 324 that provides the force necessary to move each exhaust conduit $\mathbf{310}_{1\text{-}n}$ from a recessed to elongated positon and vice versa. In some embodiments, the telescoping exhaust conduits $\mathbf{310}_{1\text{-}n}$ may utilize hydraulic cylinders as a vent drive; in other embodiments, the telescoping exhaust conduits $\mathbf{310}_{1\text{-}n}$ may utilize pneumatic cylinders as a vent drive. In still other embodiments, the telescoping exhaust conduits $\mathbf{310}_{1\text{-}n}$ may user a belt or chain drive. However, these are merely exemplary, as any other type of drive mechanism known in the art may be used in order to provide a movement to and from a recessed to elongated positon.

In some embodiments, such as illustrated in FIGS. 3A-B, each of the telescoping exhaust conduits $\mathbf{310}_{1\text{-}n}$ may be coupled with a single fan 315. As such, two modes of ventilation may exist. A first mode, occurring when all of the telescoping exhaust conduits $\mathbf{310}_{1\text{-}n}$ and repositionable vent arms $\mathbf{305}_{1\text{-}n}$ are in a recessed position (A), that provides general ventilation of the cooktop. A second mode, occurring when one or more of the telescoping exhaust conduits $\mathbf{310}_{1\text{-}n}$ and repositionable vent arms $\mathbf{305}_{1\text{-}n}$ are in an elongation position (B), that provides focused ventilation to the cooking elements or zones where the repositionable vent arms $\mathbf{305}_{1\text{-}n}$ are elongated.

As illustrated in FIGS. 3A-B, there may be four repositionable vent arms $\mathbf{305}_{1\text{-}n}$, each corresponding to one cooking element and defining four ventilation zones on the cooktop. However, this is not to be understood as limiting, as in other embodiments, there may be more than four repositionable vent arms $\mathbf{305}_{1\text{-}n}$, for example in cooktops with five cooking elements there may be five repositionable vent arms $\mathbf{305}_{1\text{-}n}$ defining five ventilation zones on the cooktop. In other embodiments, there may be less than four repositionable vent arms $\mathbf{305}_{1\text{-}n}$. Furthermore, in some embodiments, such as illustrated in FIG. 3B, the housing 302 may additionally include one or more lights 320 for illuminating the cooking surface and one or more sensors 325 (described in detail herein). Moreover, the number of repositionable vent arms may differ from the number of cooking elements in some embodiments, e.g., four vent arms may provide four quadrants of focused venting over a cooktop includes five or six cooking elements.

Additionally, various sensing technologies may be utilized in the cooking appliance to facilitate positioning of the repositionable vent arm(s) 105, 205, $\mathbf{305}_n$ illustrated in FIGS. 1A-B, 2, and 3A-B. It is to be understood that any of the sensing technologies described herein may be utilized with any of the repositionable vent arms described herein and illustrated in FIGS. 1A-B, 2, and 3A-B. However, solely for ease of description, these sensing technologies will be described with reference made only to the repositionable vent arm 105 illustrated in FIG. 1.

In some embodiments, the venting appliance 100 may include one or more thermal sensors 125 that may be capable of detecting when a particular cooking element 16 emanates heat. Through use of a controller, described in detail with respect to FIG. 4, the repositionable vent arm 105 may be repositioned in response to a signal from the thermal sensor 125. For example, where the thermal sensor 125 detects that a particular cooking element 16 is on and thus heat is emanating, the repositionable vent arm 105 may be positioned over, or closer to, that particular cooking element. In other embodiments, the venting appliance 100 may include sensors to detect volatile organic compounds and/or particles; in still other embodiments, the venting appliance 100 may include humidity sensors.

In some embodiments, the thermal sensor 125 may be incorporated into a thermal imaging system. In other embodiments, such a thermal sensor 125 may be a thermistor, or a thermally sensitive resistor that functions by exhibiting a large, predictable, and precise change in electrical resistance when subjected to a corresponding change temperature. In still other embodiments, the thermal sensor 125 may be a thermocouple, a resistance thermometer, and/or any other type of thermal sensor known in the art. In some embodiments, the thermal sensor may even be disposed on or proximate to the cooktop, rather than in the venting appliance itself.

In some embodiments, the signal from the thermal sensor 125, regardless of the form the sensor takes, may be utilized by the controller to determine which cooking element 16 has been activated. For example, where the thermal sensor 125 is incorporated as part of a thermal imaging system, the thermal sensor may provide one or more signals to the controller regarding if heat and/or how much heat, is emanating from each of the cooking elements 16. In other embodiments, there may a thermal sensor 125 corresponding to each cooking element, in order to facilitate the controller's determination of which cooking element is active.

In other embodiments, the controller may determine which cooking element 16 has been activated based on a signal received from the cooking appliance 10. As a non-limiting example, the cooking appliance may send the controller a wired or wireless signal that a cooking element 16 is active when a user actuates one or more particular user controls.

In some embodiments, the repositionable vent arm 105 may include an ultrasonic or other distance sensor that may be capable of detecting a distance to a pot, pan, skillet, or the like on a cooking element 16. For example, the ultrasonic sensor 130 may utilize a transducer to send a pulse and to receive the echo; the sensor 130 and/or the controller may then determine a distance to a target (in this case a pot, pan, skillet, or the like) by measuring time lapses between the sending and receiving of the ultrasonic pulse. Through use of a controller, described in detail with respect to FIG. 4, the repositionable vent arm 105 may be repositioned in response to a signal from the ultrasonic sensor. For example, the ultrasonic sensor 130 may be used to reposition the repositionable vent arm 105 within a predetermined distance (e.g. 3 inches, 6 inches, etc.) from the detected object (e.g. pot, pan, etc.). The use of an ultrasonic sensor may allow for the position of repositionable vent arm(s) to be customized based on what a user is cooking at a particular time. For example, at a first point in time a user may be using a skillet, and as such the repositionable vent arm(s) 105 may be positioned closer to the cooktop 14; while at a second point in time the user may be using a large stock pot, and as such the repositionable vent arm(s) 105 may be positioned farther away from the cooktop 14.

It is to be understood that the use of a thermal sensor 125 and an ultrasonic sensor 130 are not mutually exclusive. In some instances, it may be desirable for the venting appliance to utilize both the thermal sensor 125 and the ultrasonic sensor 130, while in other instances only one or the other may be desirable.

In some embodiments, the venting appliance 100, 200, 300 may be disposed on the underside of and integrated with a microwave or other type of oven that is designed to be mounted above a cooktop. In other embodiments, the venting appliance 100, 200, 300 may be a vent hood.

As mentioned previously, a cooking appliance consistent with the invention also generally includes one or more controllers configured to control the cooking elements and otherwise perform cooking operations at the direction of a user. In addition, as will become more apparent below, a controller of a cooking appliance in some embodiments may also be configured to communicate a control signal to selectively actuate one or more repositionable vent arms in connection with the activation of a cooking element(s).

Figure 4:
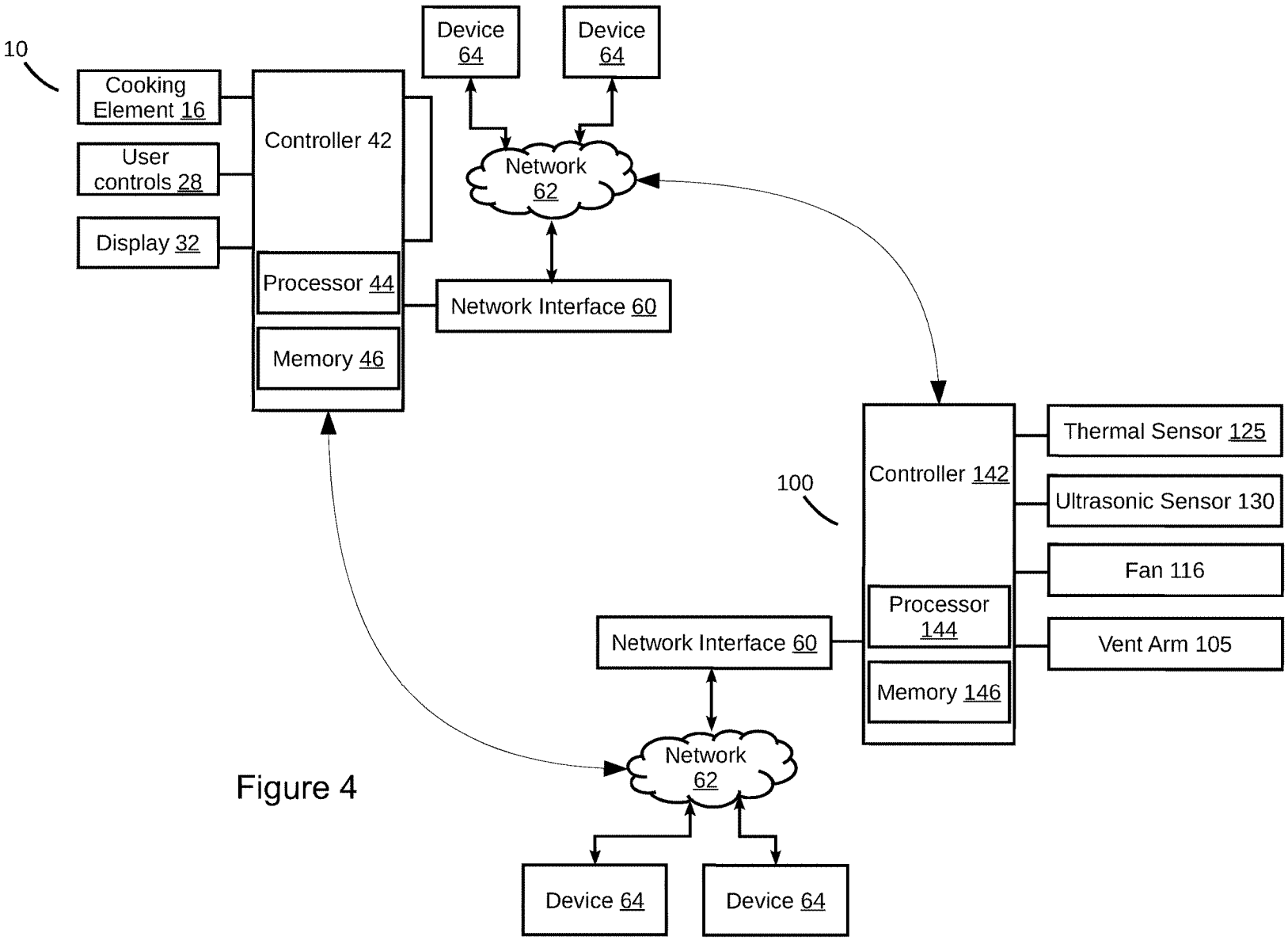
FIG. 4 is a block diagram of an example control system for a cooking appliance consistent with some embodiments of the invention.

FIG. 4, for example, illustrates an example embodiment of a cooking appliance 10 including a controller 42 and a venting appliance including a controller 142, both of which receive inputs from a number of components and drive a number of components in response thereto. Cooking appliance 10 may be implemented using practically any type of cooking appliance, e.g., a range, stovetop, etc. Controllers 42, 142 may, for example, include one or more processors 44, 144 and a memory 46, 146 within which may be stored program code for execution by the one or more processors. The memory may be embedded in controller 42, 142, but may also be considered to include volatile and/or non-volatile memories, cache memories, flash memories, programmable read-only memories, read-only memories, etc., as well as memory storage physically located elsewhere from controller 42, 142, e.g., in a mass storage device or on a remote computer interfaced with controller 42, 142.

As shown in FIG. 4, controller 42 may be disposed within the cooking appliance and may be interfaced with various components, including various cooking elements 16 used for cooking food (e.g., various combinations of gas, electric, inductive, light, microwave, light cooking elements, among others), one or more user controls 28 for receiving user input (e.g., various combinations of switches, knobs, buttons, sliders, touchscreens, microphones, imaging devices, etc.), and a user display 32 (including various indicators, graphical displays, textual displays, speakers, etc.), as well as various additional components suitable for use in a cooking appliance, e.g., lighting 54, etc. Controller 42 may also be interfaced with the repositionable vent arm 105 and fan 116, via a wired or wireless connection, in order to control their operation. In some embodiments, such as illustrated in FIG. 4, controller 42 may be interfaced with the repositionable vent arm 105 and fan 116 via a network connection with controller 142 in the venting appliance. In other embodiments, controller 42 may be directly interfaced with the repositionable vent arm 105 and fan 116 via a wired connection. Controller 42 may also be interfaced with the thermal sensor 125 and ultrasonic sensor 130, which may sense the activation of a cooking element 16 through heat and distance to a pot or pan disposed on a cooking element 16, respectively.

In some embodiments, controllers 42, 142 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 4 at 62. Network 62 may incorporate in some embodiments a home automation network, which may be used to communicate control signals between cooking appliance 10, venting appliance 100, and various non-cooking external devices, e.g. one or more smartphone, tablet, etc. devices 66.

In some embodiments, controllers 42, 142 may operate under the control of an operating system and may execute or otherwise rely upon various computer software applications, components, programs, objects, modules, data structures, etc. In addition, controllers 42, 142 may also incorporate hardware logic to implement some or all of the functionality disclosed herein. Further, in some embodiments, the sequences of operations performed by controllers 42, 142 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Although described and illustrated as two separate controllers 42, 142, this is not to be understood as limiting. In some embodiments, a single controller may be disposed within the cooking appliance. In such instances, the cooking appliance may send or receive various signals to or from the venting appliance. In other embodiments, a single controller may be disposed within the venting appliance. In such instances, the venting appliance may receive various signals from the cooking appliance (e.g. regarding user actuation of user controls). In some embodiments, these signals may be received via wired communication, while in other embodiments the venting appliance may have a wireless receiver configured to receive these signals wirelessly.

Numerous variations and modifications to the venting appliances 100, 200, 300 illustrated in FIGS. 1-4 will be apparent to one of ordinary skill in the art, as will become apparent from the description below. Therefore, the invention is not limited to the specific implementations discussed herein.

Figure 5:
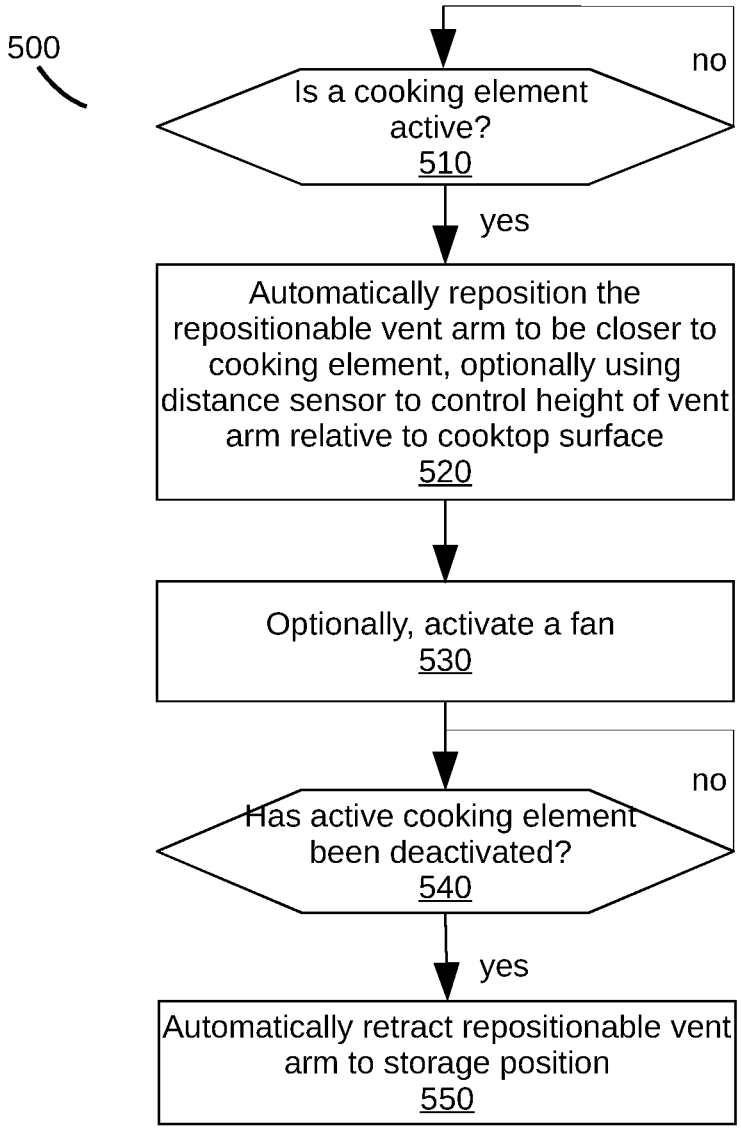
FIG. 5 is a flowchart illustrating an example sequence of operations for controlling one or more repositionable vent arms consistent with some embodiments of the invention.

Now turning to FIG. 5, which is a flowchart illustrating an example sequence of operations 500 for the repositionable vent arm(s) 105, 205, $\mathbf{305}_{1\text{-}n}$ illustrated in FIGS. 1A-B, 2, and 3A-B. At block 510, a controller determines if a cooking element is active. At block 520, if the cooking element is active the controller will automatically reposition a repositionable vent arm to be closer to the cooking element that was determined to be active. If a cooking element is not active, the controller will continue to wait for an indication that a cooking element is active. In some embodiments, the determination that a cooking element is active may include the controller receiving a signal from a thermal sensor (e.g. thermal sensor 125) that heat is emanating from a cooking element. In other embodiments, the determination that a cooking element is active may include the controller receiving a signal from the cooking appliance. In such instances, the signal may be generated in response to a cooking element being activated in response to a user input (e.g. user actuation of one or more user controls). In some embodiments, the signal from the cooking appliance may be communicated through one or more wired connections. In other embodiments, the signal from the cooking appliance may be wirelessly communicated; however, in such embodiments the venting appliance may additionally include a wireless receiver that is configured to receive the wireless signal from the cooking appliance.

Optionally, the repositionable vent arm may include an ultrasonic or other distance sensor that may be capable of detecting a distance to a pot, pan, skillet, or the like on a cooking element, and as such, block 520 may use such a distance sensor to control a height of the vent arm relative to the cooktop surface. For example, the ultrasonic sensor may be used to position the repositionable vent arm within a predetermined distance (e.g. 3 inches, 6 inches, etc.) from the detected object (e.g. pot, pan, etc.).

In some embodiments, such as illustrated at optional block 530, the sequence of operations may additionally include the controller activating a fan in response to the determination that a cooking element is active. Such a fan, when active, may draw air through the repositionable vent arm in order to provide ventilation to an area. In some embodiments, the fan may be a focused fan that is dedicated to one or more vent arms, while in other embodiments the fan may be the same fan as is used for area ventilation. In some embodiments, both types of fans may be simultaneously controlled (e.g., to provide general ventilation for the entire cooktop using one fan and then providing focused ventilation (e.g., at a higher rate) for a particular cooking element.

In some embodiments, the vent arm additionally includes a vent arm drive (e.g. a motor, one or more hydraulic cylinders, one or more pneumatic cylinders, a belt or chain drive, or the like) that is capable of mechanically moving the repositionable vent arm vertically (e.g. generally perpendicular to the cooktop). In such instances, the vent arm drive may be coupled to the controller such that when the controller determines that a cooking element is active the vent arm drive repositions the vent arm to be closer to the cooking element by actuating the vent arm drive to move the vent arm vertically. In other embodiments, there may be a second vent arm drive coupled to the controller that is capable of mechanically moving the repositionable vent arm horizontally (e.g. a direction generally parallel to the cooktop) in response to the controller's determination that a cooking element is active in order to be closer to the cooking element.

At block 540, the controller determines if a cooking element has been deactivated. At block 550, if the cooking element has been deactivated the controller will automatically retract the repositionable vent arm to a storage position. If a cooking element is still active, the controller will continue to wait for an indication that a cooking element has been deactivated. Similar to block 510, the determination that the cooking element has been deactivated may include the controller receiving a signal from a thermal sensor (e.g. thermal sensor 125) that heat is no longer emanating from a cooking element. In other embodiments, the determination that a cooking element has been deactivated may include the controller receiving a signal from the cooking appliance, for example the signal may be generated in response to a user input (e.g. user actuation of one or more user controls). In some embodiments, retracting the repositionable vent arm to a storage position may including moving the repositionable vent arm vertically until the repositionable vent arm is positioned just below the housing. In other embodiments, retracting the repositionable vent arm to a storage position may include moving the repositionable vent arm vertically until the repositionable vent arm is positioned within the housing.

It will be appreciated that various modifications may be made to the embodiments discussed herein, and that a number of the concepts disclosed herein may be used in combination with one another or may be used separately. Therefore, the invention is in the claims hereinafter appended.

What is claimed is:

1. A venting appliance for use with a cooking appliance of a type including a cooktop with at least one cooking element disposed thereon, the venting appliance comprising:

a housing configured to be positioned above the cooktop;

a repositionable vent arm coupled to and extending below the housing, the repositionable vent arm including an inlet disposed at an opposite end of the repositionable vent arm from the housing;

a first fan coupled to the repositionable vent arm to draw air through the inlet of the repositionable vent arm to provide focused ventilation proximate the inlet of the repositionable vent arm;

an area inlet disposed in the housing; and a second fan configured to draw air through the area inlet to provide area ventilation for the cooktop; wherein the first and second fans are independently controllable by a user.

2. The venting appliance of claim 1, further comprising a controller coupled to the repositionable vent arm and configured to determine that a first cooking element among the at least one cooking element is active, and in response thereto, automatically reposition the vent arm to be closer to the first cooking element.

3. The venting appliance of claim 2, further comprising a vent arm drive coupled to the controller and configured to move the vent arm in a direction generally perpendicular to the cooktop, and wherein the controller is configured to automatically reposition the vent arm to be closer to the first cooking element by actuating the vent arm drive to move the vent arm in the direction generally perpendicular to the cooktop.

4. The venting appliance of claim 3, wherein the vent arm drive comprises a first vent arm drive, wherein the venting appliance further comprises a second vent arm drive configured to move the vent arm in a direction generally parallel to the cooktop, and wherein the controller is configured to automatically reposition the vent arm to be closer to the first cooking element further by actuating the second vent arm drive to move the vent arm generally parallel to the cooktop.

5. The venting appliance of claim 3, wherein the vent arm drive comprises a belt drive.

6. The venting appliance of claim 3, wherein the vent arm includes a set of telescoping cylinders that are selectively extended in response to the vent arm drive.

7. The venting appliance of claim 2, wherein the controller determines that the first cooking element is active based on a signal from a thermal sensor positioned to detect heat emanating from the first cooking element.

8. The venting appliance of claim 2, wherein the repositionable vent arm further includes a distance sensor coupled to the controller and configured to sense a distance to an object disposed on the first cooking element, wherein the controller is configured to reposition the repositionable vent arm in response to a signal from the distance sensor.

9. The venting appliance of claim 2, wherein the controller determines that the first cooking element is active based on a signal received from the cooking appliance.

10. The venting appliance of claim 9, wherein the signal comprises a wireless signal generated in response to the first cooking element being put in an active state in response to user input, wherein the venting appliance further comprises a wireless receiver configured to receive the wireless signal from the cooking appliance.

11. The venting appliance of claim 2, wherein the controller is disposed in the housing.

12. The venting appliance of claim 2, wherein the controller is disposed in the cooking appliance.

13. The venting appliance of claim 2, wherein the controller is configured to activate the fan in response to the determination that the first cooking element is active.

14. The venting appliance of claim 2, wherein the repositionable vent arm is a first vent arm among plurality of vent arms, each of which disposed above an associated cooking element among the at least of cooking element, and wherein the controller is configured to automatically reposition each of the plurality of vent arms to be closer to the associated cooking element for such vent arm in response to determining that the associated cooking element for such vent arm is active.

15. The venting appliance of claim 1, wherein the repositionable vent arm is rotatable about an axis of rotation that is generally perpendicular to the cooktop, wherein the repositionable vent arm includes a laterally-extending member disposed at an opposite end of the repositionable vent arm from the housing, wherein an inlet of the repositionable vent arm is disposed at an opposite end of the laterally-extending member from the axis of rotation, and wherein rotation of the repositionable vent arm repositions the inlet in a direction generally parallel to the cooktop.

16. The venting appliance of claim 1, wherein the venting appliance is disposed on an underside of a microwave oven.

17. The venting appliance of claim 1, wherein the venting appliance is a vent hood.

* * * * *